United States Patent [19]

Davis

[11] Patent Number: 4,582,618

[45] Date of Patent: Apr. 15, 1986

[54] LOW PHOSPHORUS- AND SULFUR-CONTAINING LUBRICATING OILS

[75] Inventor: Kirk E. Davis, Euclid, Ohio

[73] Assignee: The Lubrizol Corporation, Wickliffe, Ohio

[21] Appl. No.: 681,962

[22] Filed: Dec. 14, 1984

[51] Int. Cl.[4] ..... C10M 151/00

[52] U.S. Cl. ..... 252/32.7 E; 252/45; 252/47.5; 252/48.4; 252/48.6; 252/48.8; 252/406

[58] Field of Search ..... 252/32.7 E, 45, 47.5, 252/48.4, 48.6, 48.8, 406

[56] References Cited

U.S. PATENT DOCUMENTS

| | | | |
|---|---|---|---|
| Re. 27,331 | 4/1972 | Coleman | 252/45 |
| 2,012,446 | 8/1935 | Edwards et al | 260/17 |
| 3,632,566 | 1/1972 | Coleman | 260/125 |
| 3,953,347 | 4/1976 | Habiby | 252/48.6 |
| 4,119,549 | 10/1978 | Davis | 252/45 |
| 4,148,738 | 4/1979 | Liston et al. | 252/32.7 E |
| 4,191,659 | 3/1980 | Davis | 252/45 |
| 4,330,420 | 5/1982 | White et al. | 252/32.7 E |
| 4,479,883 | 10/1984 | Shaub et al. | 252/32.7 E |

*Primary Examiner*—Jacqueline V. Howard

*Attorney, Agent, or Firm*—Denis A. Polyn; Forrest L. Collins; Karl Bozicevic

[57] ABSTRACT

Lubricating oil compositions containing less than about 0.1% by weight of phosphorus are described, and these lubricating compositions comprise a major amount of an oil of lubricating viscosity, and a minor amount of at least one oil-soluble sulfur-containing material which comprises the reaction product of sulfur and a Diels-Alder adduct in a molar ratio less than 1.7:1 wherein the adduct is an adduct of at least one dienophile with at least one aliphatic conjugated diene. Such lubricating oil compositions exhibit improved oxidation-corrosion-inhibiting properties, anti-wear properties, and/or extreme pressure properties. Such lubricating compositions also exhibit improved compatibility with nitrile seals.

18 Claims, No Drawings

LOW PHOSPHORUS- AND SULFUR-CONTAINING LUBRICATING OILS

TECHNICAL FIELD OF THE INVENTION

This invention relates to lubricating oil compositions containing less than about 0.1% by weight of phosphorus and minor amounts of the reaction product of sulfur and a Diels-Alder adduct. More particularly, the present invention relates to low phosphorus-containing lubricants which exhibit improved performance when in contact with nitrile seals.

BACKGROUND OF THE INVENTION

Various compositions prepared by the sulfurization of olefins and olefin-containing compounds are known in the art, as are lubricants containing these products. Typical sulfurized compositions prepared by reacting olefins such as isobutene, diisobutene, and triisobutene with sulfur under various conditions are described in, for example, *Chemical Reviews,* 65, 237 (1965). Other references describe the reaction of such olefins with hydrogen sulfide to form predominantly mercaptans with sulfides, disulfides and higher polysulfides also being formed as by-products. Reference is made to *J. Am. Chem. Soc.,* 60, 2452 (1938), and U.S. Pat. No. 3,419,614. The patent describes a process for increasing the yield of mercaptan by carrying out the reaction of olefin with hydrogen sulfide and sulfur at a high temperature in the presence of various basic materials.

It also has been known that Diels-Alder adducts can be sulfurized to form sulfur-containing compositions which are particularly useful as extreme pressure and anti-wear additives in various lubricating oils. U.S. Pat. Nos. 3,632,566 and Reissue 27,331 describe such sulfurized Diels-Alder adducts and lubricants containing said adducts. In these patents, the ratio of sulfur to Diels-Alder adduct is described as being a molar ratio of from about 0.5:1.0 to 10.0:1.0. The patents indicate that it is normally desirable to incorporate as much stable sulfur into the compound as possible, and therefore, a molar excess of sulfur normally is employed. The disclosed lubricating compositions may contain other additives normally used to improve the properties of lubricating compositions such as dispersants, detergents, extreme pressure agents, and additional oxidation and corrosion-inhibiting agents, etc. For some lubricant applications, however, the above-described sulfur-containing compositions have not been entirely adequate as multi-purpose additives.

Organophosphorus and metal organophosphorus compounds are used extensively in lubricating oils as extreme pressure agents and anti-wear agents. Examples of such compounds include: phosphosulfurized hydrocarbons such as the reaction product of a phosphorus sulfide with turpentine; phosphorus esters including dihydrocarbon and trihydrocarbon phosphites; and metal phosphorodithioates such as zinc dialkylphosphorodithioates. Because of the toxicological problems associated with the use of organophosphorus compounds, and particularly with the metal dialkylphosphorodithioates, there is a need to develop lubricant compositions containing low levels of phosphorus yet characterized as having acceptable oxidation inhibition and anti-wear properties. Lubricants containing low levels of phosphorus also are desirable in view of the tendency of phosphorus to poison catalytic converters used to control emissions from gasoline engines.

SUMMARY OF THE INVENTION

Lubricating oil compositions containing less than about 0.1% by weight of phosphorus are described, and these lubricating compositions comprise a major amount of an oil of lubricating viscosity, and a minor amount of at least one oil-soluble sulfur-containing material which comprises the reaction product of sulfur and a Diels-Alder adduct in a molar ratio less than 1.7:1 wherein the adduct is an adduct of at least one dienophile with at least one aliphatic conjugated diene. Such lubricating oil compositions exhibit improved oxidation-corrosion-inhibiting properties, anti-wear properties, and/or extreme pressure properties. Such lubricating compositions also exhibit improved compatibility with nitrile seals.

DETAILED DESCRIPTION OF THE PREFERRED EMBODIMENTS

The lubricating oil compositions of the present invention contain less than about 0.1% by weight of phosphorus, and more generally less than about 0.08% by weight of phosphorus. In some instances, the compositions may contain no phosphorus. Generally, the phosphorus which is present within the lubricating oil compositions of the present invention is in the form of a phosphorodithioate, and more particularly, as Group II metal phosphorodithioates, organic phosphites such as trialkyl phosphites, etc. Lubricating oil compositions containing less than about 0.1% by weight of phosphorus, and more preferably less than about 0.08% by weight of phosphorus generally are known in the art as "low phosphorus lubricating oils".

The lubricating oil compositions of the present invention comprise a major amount of oil of lubricating viscosity, including natural and synthetic lubricating oils and mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl-phenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The lubricating oil compositions of the present invention also contain a minor amount of at least one oil-soluble sulfur-containing material which comprises the reaction product of sulfur and a Diels-Alder adduct in a molar ratio of less than 1.7:1. The Diels-Alder adducts are a well-known, art-recognized class of compounds prepared by the diene synthesis or Diels-Alder reaction. A summary of the prior art relating to this class of compounds is found in the Russian monograph, *Dienovyi Sintes,* Izdatelstwo Akademii Nauk SSSR, 1963 by A. S. Onischenko. (Translated into the English language by L. Mandel as A. S. Onischenko, *Diene Synthesis,* N.Y., Daniel Davey and Co., Inc., 1964.) This monograph and references cited therein are incorporated by reference into the present specification.

Basically, the diene synthesis (Diels-Alder reaction) involves the reaction of at least one conjugated diene, >C=C—C=C<, with at least one ethylenically or acetylenically unsaturated compound, >C=C< or —C=C—, these latter compounds being known as dienophiles. The reaction can be represented as follows:

Reaction 1:

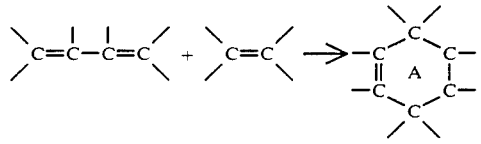

Reaction 2:

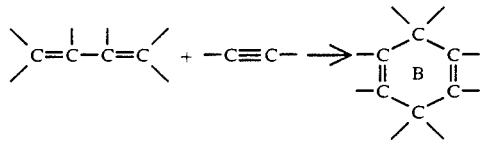

The products, A and B are commonly referred to as Diels-Alder adducts. It is these adducts which are used as starting materials for the preparation of the sulfurized Diels-Alder adducts utilized in the invention.

Representative examples of such 1,3-dienes include aliphatic conjugated diolefins or dienes of the formula

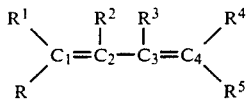

(I)

wherein R through $R^5$ are each independently selected from the group consisting of halogen, alkyl, halo, alkoxy, alkenyl, alkenyloxy, carboxy, cyano, amino, alkylamino, dialkylamino, phenyl, and phenyl-substituted with 1 to 3 substituents corresponding to R through $R^5$ with the proviso that a pair of R's on adjacent carbons do not form an additional double bond in the diene. Preferably not more than three of the R variables are other than hydrogen and at least one is hydrogen. Normally the total carbon content of the diene will not exceed 20. In one preferred aspect of the invention, adducts are used where $R^2$ and $R^3$ are both hydrogen and at least one of the remaining R variables is also hydrogen. Preferably, the carbon content of these R variables when other than hydrogen is 7 or less. In this most preferred class, those dienes where R, $R^1$, $R^4$, and $R^5$ are hydrogen, chloro, or lower alkyl are especially useful. Specific examples of the R variables include the following groups: methyl, ethyl, phenyl, HOOC—, N≡C—, $CH_3O$—, $CH_3COO$—, $CH_3CH_2O$—, $CH_3C(O)$—, HC(O)—, Cl, Br, tert-butyl, $CF_3$, tolyl, etc. Piperylene, isoprene, methylisoprene, chloroprene, and 1,3-butadiene are among the preferred dienes for use in preparing the Diels-Alder adducts.

In addition to these linear 1,3-conjugated dienes, cyclic dienes are also useful as reactants in the formation of the Diels-Alder adducts. Examples of these cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclononatrienes. Various substituted derivatives of these compounds enter into the diene synthesis.

The dienophiles suitable for reacting with the above dienes to form the adducts used as reactants can be represented by the formula

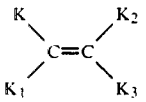

(II)

wherein the K variables are the same as the R variables in Formula I above with the proviso that a pair of K's may form an additional carbon-to-carbon bond, i.e., K—C≡C—$K_2$, but do not necessarily do so.

A preferred class of dienophiles are those wherein at least one of the K variables is selected from the class of electron-accepting groups such as formyl, cyano, nitro, carboxy, carbohydrocarbyloxy, hydrocarbylcarbonyl, hydrocarbylsulfonyl, carbamyl, acylcarbamyl, N-acyl-N-hydrocarbylcarbamyl, N-hydrocarbylcarbamyl, and N,N-dihydrocarbylcarbamyl. Those K variables which are not electron-accepting groups are hydrogen, hydrocarbyl, or substitutedhydrocarbyl groups. Usually the hydrocarbyl and substituted hydrocarbyl groups will not contain more than 10 carbon atoms each.

The hydrocarbyl groups present as N-hydrocarbyl substituents are preferably alkyl of 1 to 30 carbons and especially 1 to 10 carbons. Representative of this class of dienophiles are the following: nitroalkenes, e.g., 1-nitrobutene-1, 1-nitropentene-1, 3-methyl-1-nitrobutene-1, 1-nitroheptene-1, 1-nitrooctene-1, 4-ethoxy-1-nitrobutene-1; alpha, beta-ethylenically unsaturated aliphatic carboxylic acid esters, e.g., alkylacrylates and alpha-methyl alkylacrylates (i.e., alkyl methacrylates) such as butylacrylate and butylmethacrylate, decyl acrylate and decylmethacrylate, di-(n-butyl)maleate, di-(t-butyl-maleate); acrylonitrile, methacrylonitrile, beta-nitrostyrene, methylvinylsulfone, acrolein, acrylic acid; alpha, betaethylenically unsaturated aliphatic carboxylic acid amides, e.g., acrylamide, N,N-dibutylacrylamide, methacrylamide, N-dodecylmethacrylamide, N-pentylcrotonamide; crotonaldehyde, crotonic acid, beta, beta-dimethyldivinylketone, methyl-vinylketone, N-vinyl pyrrolidone, alkenyl halides, and the like.

One preferred class of dienophiles are those wherein at least one, but not more than two of K variables is —C(O)O—$R_o$ where $R_o$ is the residue of a saturated aliphatic alcohol of up to about 40 carbon atoms; e.g., for example at least one K is carbohydrocarbyloxy such as carboethoxy, carbobutoxy, etc., the aliphatic alcohol from which -$R_o$ is derived can be a mono or polyhydric alcohol such as alkyleneglycols, alkanols, aminoalkanols, alkoxysubstituted alkanols, ethanol, ethoxy ethanol, propanol, beta-diethylaminoethanol, dodecyl alcohol, diethylene glycol, tripropylene glycol, tetrabutylene glycol, hexanol, octanol, isooctyl alcohol, and the like. In this especially preferred class of dienophiles, not more than two K variables will be —C(O)—O—$R_o$ groups and the remaining K variables will be hydrogen or lower alkyl, e.g., methyl, ethyl, propyl, isopropyl, and the like.

Specific examples of dienophiles of the type discussed above are those wherein at least one of the K variables is one of the following groups: hydrogen, methyl, ethyl, phenyl, HOOC—, HC(O)—, $CH_2$=CH—, HC≡C—, $CH_3C(O)O$—, $ClCH_2$—, $HOCH_2$—, alpha-pyridyl, —$NO_2$, Cl, Br, propyl, iso-butyl, etc.

In addition to the ethylenically unsaturated dienophiles, there are many useful acetylenically unsaturated dienophiles such as propiolaldehyde, methylethynylketone, propylethynylketone, propenylethynylketone, propiolic acid, propiolic acid nitrile, ethylpropiolate, tetrolic acid, propargylaldehyde, acetylenedicarboxylic acid, the dimethyl ester of acetylenedicarboxylic acid, dibenzoylacetylene, and the like.

Cyclic dienophiles include cyclopentenedione, coumarin, 3-cyanocoumarin, dimethyl maleic anhydride, 3,6-endomethylene-cyclohexenedicarboxylic acid, etc. With the exception of the unsaturated dicarboxylic anhydrides derived from linear dicarboxylic acids (e.g., maleic anhydride, methylmaleic anhydride, chloromaleic anhydride), this class of cyclic dienophiles are limited in commercial usefulness due to their limited availability and other economic considerations.

The reaction products of these dienes and dienophiles correspond to the general formulae

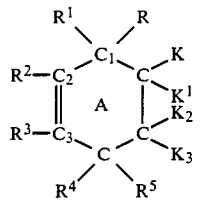

(III)

and

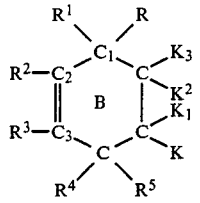

wherein R through $R^5$ and K through $K_3$ are as defined hereinbefore. If the dienophile moiety entering into the reaction is acetylenic rather than ethylenic, two of the K variables, one from each carbon, form another carbon-to-carbon double bond. Where the diene and/or the dienophile is itself cyclic, the adduct obviously will be bicyclic, tricyclic, fused, etc., as exemplified below:

Reaction 3:

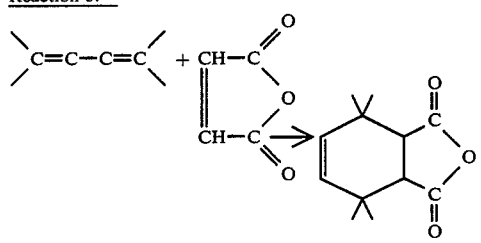

-continued

Reaction 4:

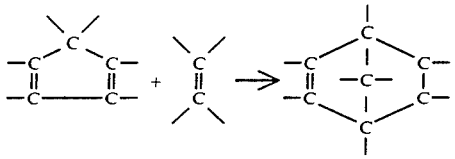

Normally, the adducts involve the reaction of equimolar amounts of diene and dienophile. However, if the dienophile has more than one ethylenic linkage, it is possible for additional diene to react if present in the reaction mixture.

The adducts and processes of preparing the adducts are further exemplified by the following examples. Unless otherwise indicated in these examples and in other parts of this specification, as well as in the appended claims, all parts and percentages are by weight.

EXAMPLE A

A mixture comprising 400 parts of toluene and 66.7 parts of aluminum chloride is charged to a two-liter flask fitted with a stirrer, nitrogen inlet tube, and a solid carbon dioxide-cooled reflux condenser. A second mixture comprising 640 parts (5 moles) of butyl acrylate and 240.8 parts of toluene is added to the $AlCl_3$ slurry while maintaining the temperature within the range of 37°-58° C. over a 0.25-hour period. Thereafter, 313 parts (5.8 moles) of butadiene is added to the slurry over a 2.75-hour period while maintaining the temperature of the reaction mass at 50°-61° C. by means of external cooling. The reaction mass is blown with nitrogen for about 0.33 hour and then transferred to a four-liter separatory funnel and washed with a solution of 150 parts of concentrated hydrochloric acid in 1100 parts of water. Thereafter, the product is subjected to two additional water washings using 1000 parts of water for each wash. The washed reaction product is subsequently distilled to remove unreacted butyl acrylate and toluene. The residue of this first distillation step is subjected to further distillation at a pressure of 9-10 millimeters of mercury whereupon 785 parts of the desired product is collected over the temperature of 105°-115° C.

EXAMPLE B

The adduct of isoprene and acrylonitrile is prepared by mixing 136 parts of isoprene, 106 parts of acrylonitrile, and 0.5 parts of hydroquinone (polymerization inhibitor) in a rocking autoclave and thereafter heating for 16 hours at a temperature within the range of 130°-140° C. The autoclave is vented and the contents decanted thereby producing 240 parts of a light yellow liquid. This liquid is stripped at a temperature of 90° C. and a pressure of 10 millimeters of mercury thereby yielding the desired liquid product as the residue.

EXAMPLE C

Using the procedure of Example B, 136 parts of isoprene, 172 parts of methyl acrylate, and 0.9 part of hydroquinone are converted to the isoprenemethyl acrylate adduct.

EXAMPLE D

Following the procedure of Example B, 104 parts of liquified butadiene, 166 parts of methyl acrylate, and 1 part of hydroquinone are charged to the rocking autoclave and heated to 130°-135° C. for 14 hours. The product is subsequently decanted and stripped yielding 237 parts of the adduct.

EXAMPLE E

The adduct of isoprene and methyl methacrylate is prepared by reacting 745 parts of isoprene with 1095 parts of methyl methacrylate in the presence of 5.4 parts of hydroquinone in the rocking autoclave following the procedure of Example B above. 1490 parts of the adduct is recovered.

EXAMPLE F

The adduct of butadiene and dibutyl maleate (810 parts) is prepared by reacting 915 parts of dibutyl maleate, 216 parts of liquified butadiene, and 3.4 parts of hydroquinone in the rocking autoclave according to the technique of Example B.

EXAMPLE G

A reaction mixture comprising 378 parts of butadiene, 778 parts of N-vinylpyrrolidone, and 3.5 parts of hydroquinone is added to a rocking autoclave previously chilled to −35° C. The autoclave is then heated to a temperature of 130°-140° C. for about 15 hours. After venting, decanting, and stripping the reaction mass, 75 parts of the desired adduct are obtained.

EXAMPLE H

Following the technique of Example B, 270 parts of liquified butadiene, 1060 parts of isodecyl acrylate, and 4 parts of hydroquinone are reacted in the rocking autoclave at a temperature of 130°-140° C. for about 11 hours. After decanting and stripping, 1136 parts of the adduct are recovered.

EXAMPLE I

Following the same general procedure of Example A, 132 parts (2 moles) of cyclopentadiene, 256 parts (2 moles) of butyl acrylate, and 12.8 parts of aluminum chloride are reacted to produce the desired adduct. The butyl acrylate and the aluminum chloride are first added to a two-liter flask fitted with stirrer and reflux condenser. While heating the reaction mass to a temperature within the range of 59°-52° C., the cyclopentadiene is added to the flask over a 0.5-hour period. Thereafter the reaction mass is heated for about 7.5 hours at a temperature of 95°-100° C. The product is washed with a solution containing 400 parts of water and 100 parts of concentrated hydrochloric acid and the aqueous layer is discarded. Thereafter, 1500 parts of benzene are added to the reaction mass and the benzene solution is washed with 300 parts of water and the aqueous phase removed. The benzene is removed by distillation and the residue stripped at 0.2 parts of mercury to recover the adduct as a distillate.

EXAMPLE J

Following the technique of Example B, the adduct of butadiene and allylchloride is prepared using two moles of each reactant.

EXAMPLE K

One-hundred thirty-nine parts (1 mole) of the adduct of butadiene and methyl acrylate is transesterified with 158 parts (1 mole) of decyl alcohol. The reactants are added to a reaction flask and 3 parts of sodium methoxide are added. Thereafter, the reaction mixture is heated at a temperature of 190°-200° C. for a period of 7 hours. The reaction mass is washed with a 10% sodium hydroxide solution and then 250 parts of naphtha is added. The naphtha solution is washed with water. At the completion of the washing, 150 parts of toluene are added and the reaction mass is stripped at 150° C. under pressure of 28 parts of mercury. A dark-brown fluid product (225 parts) is recovered. This product is fractionated under reduced pressure resulting in the recovery of 178 parts of the product boiling in the range of 130°-133° C. at a pressure of 0.45 to 0.6 parts of mercury.

EXAMPLE L

The general procedure of Example A is repeated except that only 270 parts (5 moles) of butadiene is included in the reaction mixture.

The sulfur-containing compounds of the present invention are readily prepared by heating a mixture of sulfur and at least one of the Diels-Alder adducts of the types discussed hereinabove at a temperature within the range of from about 110° C. to just below the decomposition temperature of the Diels-Alder adducts. Temperatures within the range of about 110° to about 200° C. will normally be used. This reaction results in a mixture of products, some of which have been identified. In the compounds of known structure, the sulfur reacts with the substituted unsaturated cycloaliphatic reactants at a double bond in the nucleus of the unsaturated reactant.

The molar ratio of sulfur to Diels-Alder adduct used in the preparation of the sulfur-containing composition is less than 1.7:1. Generally, the molar ratio of sulfur to unsaturated reactant will be about 0.5:1 up to about 1.7:1 and in one preferred embodiment, the ratio will be less than 1:1.

The reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

As hydrogen sulfide is an undesirable contaminent, it is advantageous to employ standard procedures for assisting in the removal of the $H_2S$ from the products. Blowing with steam, alcohols, air, or nitrogen gas assists in the removal of $H_2S$ as does heating at reduced pressures with or without the blowing.

When the Diels-Alder adduct is of the type represented by Formula III (A) or (B), the sulfur-containing products of known structure correspond to the following generic formulae:

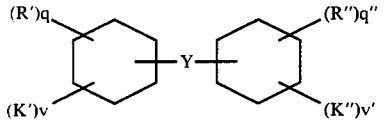

(IV)

-continued

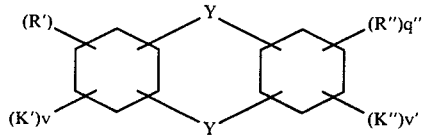

(V)

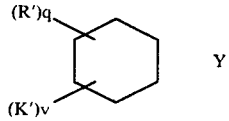

(VI)

wherein R' and R" are the same as R through $R^5$ above and K' and K" are the same as K through $K_3$ above. Y is a divalent sulfur group. The variables q and q" are zero or a positive whole number of 1 to 6 while v and v' are zero or positive whole numbers of 1 to 4, at least one of R', R", K', and K" in each compound being other than hydrogen or a saturated aliphatic hydrocarbon group. Generally not more than five of the R and K variables on each ring are other than hydrogen. Preferably, at least one K variable in each compound will be an electron accepting group of the type discussed supra. The preferred class of substituents discussed hereinbefore with regard to the various "K" and "R" variables on the intermediates for making the Diels-Alder adducts and the adducts themselves obviously applies to the final products prepared from the intermediates.

An especially preferred class of sulfurized Diels-Alder adducts within the ambit of Formulae IV—VI is that wherein at least one of the K variables is an electron accepting group from the class consisting of $$-\overset{\overset{W''}{\|}}{C}-R_7,\ -\overset{\overset{O}{\|}}{\underset{\underset{O}{\|}}{S}}-R_7,\ -C\equiv N,\ \text{and}\ -NO_2$$

wherein W" is oxygen or divalent sulfur, and $R_7$ is hydrogen, halo, alkyl of 1 to 30 carbons, alkenyl of 1 to 30 carbons, hydroxy, alkoxy of 1 to 30 carbons, alkenoxy of 1 to 30 carbons, amino, alkylamino and dialkylamine wherein the alkyl groups contain from 1 to 30 carbons and preferably 1 to 10 carbons. Preferably, W" is oxygen. When $R_7$ is halo, chloro is preferred. Particularly useful are those compounds wherein the R's are hydrogen or lower alkyl and one K variable is carboalkoxy of up to 31 carbon atoms, the remaining K groups being hydrogen, lower alkyl, or another electron accepting group. Within this latter group, those wherein the carboalkoxy group is carbo-n-butoxy produce excellent results as lubricant additives.

It is sometimes advantageous to incorporate materials useful as sulfurization catalysts in the reaction mixture. These materials may be acidic, basic or neutral. Useful neutral and acidic materials include acidified clays such as "Super Filtrol", p-toluenesulfonic acid, dialkylphosphorodithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1–20 carbon atoms. Suitable amines include aniline, benzylamine, dibenzylamine, dodecylamine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The preferred basic catalysts include ammonia and primary, secondary, or tertiary alkylamines having about 1–8 carbon atoms in the alkyl radicals. Representative amines of this type are methylamine, dimethylamine, trimethylamine, ethylamine, diethylamine, triethylamine, di-n-butylamine, tri-n-butylamine, tri-sec-hexylamine and tri-n-octylamine. Mixtures of these amines can be used, as well as mixtures of ammonia and amines.

When a catalyst is used, the amount is generally about 0.05–2.0% of the weight of the adduct.

The following examples illustrate the preparation of the novel sulfur-containing compounds useful in the present invention.

EXAMPLE I

To 255 parts (1.65 moles) of the isoprenemethacrylate adduct of Example C heated to a temperature of 110°–120° C., there are added 53 parts (1.65 moles) of sulfur flowers over a 45-minute period. The heating is continued for 4.5 hours at a temperature in the range of 130°–160° C. After cooling to room temperature, the reaction mixture is filtered through a medium sintered glass funnel. The filtrate consists of 301 parts of the desired sulfur-containing products.

EXAMPE II

A reaction mixture comprising 1175 parts (6 moles) of the Diels-Alder adduct of butyl acrylate and isoprene and 192 parts (6 moles) of sulfur flowers is heated for 0.5 hour at 108°–110° C. then to 155°–165° C. for 6 hours while bubbling nitrogen gas through the reaction mixture of 0.25 to 0.5 standard cubic feet per hour. At the end of the heating period, the reaction mixture is allowed to cool and filtered at room temperature. Thereafter, the product is permitted to stand for 24 hours and refiltered. The filtrate is the desired product.

EXAMPLE III

Sulfur (4.5 moles) and the adduct of isoprene-methyl methacrylate (4.5 moles) are mixed at room temperature and heated for one hour at 110° C. while blowing nitrogen through the reaction mass at 0.25–0.5 standard cubic feet per hour. Subsequently the reaction mixture is raised to a temperature of 150°–155° C. for 6 hours while maintaining the nitrogen blowing. After heating, the reaction mass is permitted to stand for several hours while cooling to room temperature and is thereafter filtered. The filtrate consists of 842 parts of the desired sulfurcontaining product.

EXAMPLE IV

A one-liter flask fitted with a stirrer, reflux, condenser, and nitrogen inlet line is charged with 256 parts (1 mole) of the adduct of butadiene and isodecyl acrylate, and 51 grams (1.6 moles) of sulfur flowers and then heated for 12 hours at a temperature, stand for 21 hours, and filtered at room temperature to produce the desired product as the filtrate.

EXAMPLE V

A mixture of 1703 parts (9.4 moles) of a butyl acrylate-butadiene adduct prepared as in Example L, 280 parts (8.8 moles) of sulfur and 17 parts of triphenyl phosphite is prepared in a reaction vessel and heated gradually over 2 hours to a temperature of about 185° C. while stirring and sweeping with nitrogen. The reaction is exothermic near 160°–170° C., and the mixture is maintained at about 185° C. for 3 hours. The mixture is cooled to 90° C. over a period of 2 hours and filtered using a filter aid. The filtrate is the desired product containing 14.0% sulfur.

EXAMPLE VI

The procedure of Example V is repeated except that the triphenyl phosphite is omitted from the reaction mixture.

EXAMPLE VII

The procedure of Example V is repeated except that the triphenyl phosphite is replaced by 2.0 parts of triamyl amine as a sulfurization catalyst.

EXAMPLE VIII

A mixture of 547 parts of a butyl acrylatebutadiene adduct prepared as in Example L and 5.5 parts of triphenyl phosphite is prepared in a reaction vessel and heated with stirring to a temperature of about 50° C. whereupon 94 parts of sulfur are added over a period of 30 minutes. The mixture is heated to 150° C. in 3 hours while sweeping with nitrogen. The mixture then is heated to about 185° C. in approximately one hour. The reaction is exothermic and the temperature is maintained at about 185° C. by using a cold water jacket for a period of about 5 hours. At this time, the contents of the reaction vessel are cooled to 85° C. and 33 parts of mineral oil are added. The mixture is filtered at this temperature, and the filtrate is the desired product wherein the sulfur to adduct ratio is 0.98/1.

EXAMPLE IX

The general procedure of Example VIII with the exception that the triphenyl phosphite is not included in the reaction mixture.

EXAMPLE X

A mixture to 500 parts (2.7 moles) of a butyl acrylate-butadiene adduct prepared as in Example L and 109 parts (3.43 moles) of sulfur is prepared and heated to 180° C. and maintained at a temperature of about 180°–190° C. for about 6.5 hours. The mixture is cooled while sweeping with a nitrogen gas to remove hydrogen sulfide odor. The reaction mixture is filtered and the filtrate is the desired product containing 15.8% sulfur.

EXAMPLE XI

A mixture of 728 parts (4.0 moles) of a butyl acrylate-butadiene adduct prepared as in Example L, 218 parts (6.8 moles) of sulfur, and 7 parts of triphenyl phosphite is prepared and heated with stirring to a temperature of about 181° C. over a period of 1.3 hours. The mixture is maintained under a nitrogen purge at a temperature of 181°–187° C. for 3 hours. After allowing the material to cool to about 85° C. over a period of 1.4 hours, the mixture is filtered using a filter aid, and the filtrate is the desired product containing 23.1% sulfur.

EXAMPLE XII

A mixture of 910 parts (5 moles) of a butyl acrylate-butadiene adduct prepared as in Example L, 208 parts (6.5 moles) of sulfur and 9 parts of triphenyl phosphite is prepared and heated with stirring and nitrogen sweeping to a temperature of about 140° C. over 1.3 hours. The heating is continued to raise the temperature to 187° C. over 1.5 hours, and the material is held at 183°-187° C. for 3.2 hours. After cooling the mixture to 89° C., the mixture is filtered with a filter aid, and the filtrate is the desired product containing 18.2% sulfur.

EXAMPLE XIII

A mixture of 910 parts (5 moles) of a butyl acrylate-butadiene adduct prepared as in Example L, 128 parts (4 moles) of sulfur and 9 parts of triphenyl phosphite is prepared and heated with stirring while sweeping with nitrogen to a temperature of 142° C. over a period of about one hour. The heating is continued to raise the temperature to 185°-186° C. over about 2 hours and the mixture is maintained at 185°-187° C. for 3.2 hours. After allowing the reaction mixture to cool to 96° C., the mixture is filtered with filter aid, and the filtrate is the desired product containing 12.0% sulfur.

EXAMPLE XIV

The general procedure of Example XIII is repeated except that the mixture contain 259 parts (8.09 moles) of sulfur. The product obtained in this manner contains 21.7% sulfur.

It has been found that, if the sulfurcontaining products of this invention are treated with an aqueous solution of sodium sulfide containing from about 5% to about 75% by weight $Na_2S$, the treated product may exhibit less of a tendency to darken freshly polished copper metal.

Treatment involves the mixing together of the sulfurized reaction product and the sodium sulfide solution for a period of time sufficient for any unreacted sulfur to be scavenged, usually a period of a few minutes to several hours depending on the amount of unreacted sulfur, the quantity and the concentration of the sodium sulfide solution. The temperature is not critical but normally will be in the range of about 20° C. to about 100° C. After the treatment, the resulting aqueous phase is separated from the organic phase by conventional techniques, i.e., decantation, etc. Other alkali metal sulfides, $M_2S_x$ where M is an alkali metal and x is 1, 2, or 3 may be used to scavenge unreacted sulfur but those where x is greater than 1 are not nearly as effective. Sodium sulfide solutions are preferred for reasons of economy and effectiveness. This procedure is described in more detail in U.S. Pat. No. 3,498,915.

It has also been determined that treatment of the reaction products with solid, insoluble acidic materials such as acidified clays or acidic resins and thereafter filtering the sulfurized reaction mass improves the product with respect to its color and solubility characteristics. Such treatment comprises thoroughly mixing the reaction mixture with from about 0.1% to about 10% by weight of the solid acidic material at a temperature of about 25°-150° C. and subsequently filtering the product.

As previously mentioned, there is no need to separate the sulfur-containing products which are produced in the above reactions. The reaction product is a mixture which comprises the compounds whose structures have been ascertained but which also comprises compounds whose structures are unknown. Since it is economically unfeasible to separate the components of the reaction mixture, they are employed in combination as a mixture of sulfur-containing compounds.

In order to remove the last traces of impurities from the reaction mixture, particularly when the adduct employed was prepared using a Lewis acid catalyst, (e.g., $AlCl_3$) it is sometimes desirable to add an organic inert solvent to the liquid reaction product and, after thorough mixing, to refilter the material. Subsequently the solvent is stripped from the product. Suitable solvents include solvents of the type mentioned hereinabove such as benzene, toluene, the higher alkanes, etc. A particularly useful class of solvents are the textile spirits.

In addition, other conventional purification techniques can be advantageously employed in purifying sulfurized products used in this invention. For example, commercial filter aids can be added to the materials prior to filtration to increase the efficiency of the filtration. Filtering through diatomaceous earth is particularly useful where the use contemplated requires the removal of substantially all solid materials. However, such expedients are well known to those skilled in the art and require no elaborate discussion herein.

The sulfur-containing products of the present invention will normally be employed in the lubricating composition of the invention in an amount sufficient to provide the desired oxidation-corrosion-inhibiting, antiwear and/or extreme pressure properties to the lubricant. More generally, this amount will be from about 0.001% to about 20% by weight of the particular oil in which they are utilized. The optimum amount to be used in a given composition obviously would depend on the contents of the particular lubricating composition, the operating conditions to which it is to be subjected, and the particular additives employed. Thus, when employed as an oxidation-corrosion inhibitor in lubricating oils for internal combustion engines, the sulfur-containing compositions of the invention will normally be employed in an amount of from about 0.05% to about 5% by weight. However, when employed as an extreme pressure additive, such as in gear lubricants, the sulfur-containing compounds will be employed in amounts of from about 1% up to about 10% by weight or even higher. In lubricating compositions operated under extremely adverse conditions, such as lubricating compositions for marine diesel engines, the sulfur-containing compositions may be present in amounts of up to about 30% by weight, or more, of the total weight of the lubricating composition.

The invention also comtemplates the use of other additives in combination with the sulfurized compositions of this invention. Such additives include, for example, detergents and dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts of alkali or alkaline earth metals with sulfonic acids or carboxylic acids. The most commonly used salts of such acids are those of sodium, potassium, lithium, calcium, magnesium, strontium and barium.

The term "basic salt" is used to designate metal salts wherein the metal is present in stoichiometrically larger amounts than the organic acid group. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent 1,306,529 and in many U.S. patents including the following: Nos.

| | | |
|---|---|---|
| 3,163,603 | 3,351,552 | 3,541,012 |
| 3,215,707 | 3,399,141 | 3,542,680 |
| 3,271,310 | 3,433,744 | 3,574,101 |
| 3,281,357 | 3,448,048 | 3,630,904 |
| 3,311,558 | 3,451,933 | 3,632,511 |
| 3,340,281 | 3,467,668 | 3,725,441 |
| 3,346,493 | 3,522,179 | Re 26,433 |

(2) Reaction products of relatively high molecular weight aliphatic or alicyclic halides with amines, preferably olyalkylene polyamines. These may be characterized as "amine dispersants" and examples thereof are described for example, in the following U.S. patents: Nos.

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative: Nos.

| | | |
|---|---|---|
| 2,459,112 | 3,442,808 | 3,591,598 |
| 2,984,550 | 3,454,497 | 3,634,515 |
| 3,166,516 | 3,461,172 | 3,697,574 |

-continued

| | | |
|---|---|---|
| 3,355,270 | 3,539,633 | 3,725,480 |
| 3,413,347 | 3,586,629 | 3,980,569 |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, or the like. Exemplary materials of this type are described in the following U.S. patents: Nos.

| | | | |
|---|---|---|---|
| 3,036,003 | 3,282,955 | 3,493,520 | 3,639,242 |
| 3,200,107 | 3,366,569 | 3,513,093 | 3,649,659 |
| 3,254,025 | 3,373,111 | 3,539,633 | 3,697,574 |
| 3,278,550 | 3,442,808 | 3,579,450 | 3,703,536 |
| 3,281,428 | 3,455,832 | 3,600,372 | 3,708,422 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. patents: Nos.

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Auxiliary extreme pressure agents and corrosion- and oxidation-inhibiting agents which may be included in the lubricants of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene. Group II metal phosphorodithioates may be included in the lubricant in small amounts provided that the overall phosphorus content of the lubricant is less than 0.1% and preferably less than 0.08%. Examples of useful metal phosphorodithioates include zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are well known examples.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, OH, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henty T. Kerner (Noyes Data Corporation, 1976), pages 125–162.

The sulfurized compositions of this invention can be added directly to the lubricant. Preferably, however, they are diluted with a substantially inert, normally liquid organic diluent such as mineral oil, naphtha, benzene, toluene or xylene, to form an additive concentrate. These concentrates usually contain from about 20% to about 90% by weight of the sulfurized compositions of this invention and may contain, in addition, one or more other additives known in the art or described hereinabove. The remainder of the concentrate is the substantially inert normally liquid diluent.

The following examples illustrate the lubricant compositions of the invention (including additive concentrates). All percentages are by weight of total composition.

The following are illustrative examples of the lubricating compositions of the present invention. All parts and percentages are by weight of the total composition unless otherwise indicated.

EXAMPLE 1

SAE 10W-30 mineral lubricating oil containing 1% of the product of Example III.

EXAMPLE 2

SAE 10W-30 mineral lubricating oil containing 3% of the product of Example V.

EXAMPLE 3

SAE 10W-30 mineral lubricating oil containing 5% of the product of Example IV, 0.05% of phosphorus as zinc di-n-octylphosphorodithioate, 10% of a chlorinated paraffin wax having a chlorine content of 40%, 0.003% of a poly(alkyl-siloxane) as an antifoaming agent, 0.02% of a pour point depressant, and 3% of a viscosity index improver.

The corrosion-inhibiting qualities of the lubricating compositions of the present invention are illustrated by an engine test on such lubricants. The CRC L-38 test is a standard test for the industry wherein the lubricant to be tested is placed in an engine equipped with special copper-lead bearings, and engine is operated for 40 hours. At the end of the 40-hour period, the bearings are weighed to determine the loss of metal during engine operation and a lubricating composition is considered to contain effective corrosion-oxidation inhibiting properties in this test if the weight loss is 40 milligrams or less.

When lubricating oil compositions of the present invention containing less than 0.1% phosphorus and wherein the sulfur-containing material comprises the reaction product of sulfur a Diels-Alder adduct in a molar ratio of less than 1.7:1 are utilized in the CRC L-38 test, such lubricants pass the test.

It also has been observed that good nitrile seal compatibility is obtained when the lubricating oil compositions of the present invention contain a sulfurized Diels-Alder adduct having a molar ratio of sulfur to adduct of less than 1:1, (and in particular, 0.93:1) are utilized.

I claim:

1. A lubricating oil composition containing less than about 0.1% by weight of phosphorus and comprising a major amount of an oil of lubricating viscosity, and a minor amount of at least one oil-soluble sulfur-containing material which comprises the reaction product of sulfur and a Diels-Alder adduct in a molar ratio of less than 1.7:1 wherein the adduct is an adduct of at least one dienophile with at least one aliphatic conjugated diene.

2. The lubricating oil composition of claim 1 containing less than about 0.1% by weight of phosphorus as a phosphorodithioate.

3. The lubricating oil composition of claim 1 containing less than about 0.08% by weight of phosphorus.

4. The lubricating oil composition of claim 1 wherein the dienophile comprises an alpha, beta-ethylenically unsaturated aliphatic carboxylic acid ester, an alpha, beta-ethylenically unsaturated aliphatic carboxylic acid amide, an alpha, beta-ethylenically unsaturated aliphatic halide, or mixtures thereof.

5. The lubricating oil composition of claim 1 wherein the aliphatic conjugated diene corresponds to the formula

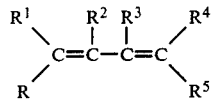

(I)

wherein R through $R^5$ are each independently selected from the group consisting of hydrogen, alkyl, halo, alkoxy, alkenyl, alkenyloxy, carboxy, cyano, amino, alkylamino, dialkylamino, phenyl, and phenyl substituted with one to three substituents corresponding to R through $R^5$.

6. The lubricating oil composition of claim 1 wherein the molar ratio of sulfur to Diels-Alder adduct is less than 1:1.

7. The lubricating composition of claim 5 wherein $R^2$ and $R^3$ are hydrogen, and R, $R^1$, $R^4$ and $R^5$ are each independently hydrogen, chloro, or lower alkyl.

8. The lubricating composition of claim 7 wherein the dienophile is further characterized in that it contains at least one, but not more than two $$-C(O)OR_0$$

wherein $R_0$ is residue of a saturated aliphatic alcohol of up to about 40 carbon atoms.

9. The lubricating composition according to claim 5 wherein the diene is piperylene, isoprene, methylisoprene, chloroprene, 1,3-butadiene, or mixtures thereof.

10. The lubricating composition according to claim 8 wherein said dienophile is an ester of acrylic acid or methacrylic acid.

11. The lubricating composition according to claim 9 wherein the diene is 1,3-butadiene.

12. The lubricating composition according to claim 1 containing an amount of the oil-soluble sulfur-containing composition which is sufficient to impart oxidation-corrosion inhibiting, anti-wear and/or extreme pressure properties to said lubricating oil composition.

13. A lubricating oil composition containing less than about 0.1% by weight of phosphorus and comprising a major amount of an oil of lubricating viscosity, and from about 0.001 to about 20% by weight of at least one oil-soluble, sulfur-containing composition which comprises the reaction product of sulfur with at least one Diels-Alder adduct, the molar ratio of sulfur to adduct being less than 1:1 wherein the adduct consists essentially of the 1:1 adduct of at least one dienophile selected from the group consisting of alpha, beta-ethylenically unsaturated aliphatic carboxylic acid amides, and alpha, beta-ethylenically unsaturated aliphatic halides with at least one aliphatic conjugated diene corresponding to the formula

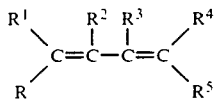

(I)

wherein R through $R^5$ are each independently selected from the group consisting of hydrogen, alkyl, halo, alkoxy, alkenyl, alkenyloxy, carboxy, cyano, amino, alkylamino, dialkylamino, phenyl, and phenyl substituted with one to three substituents corresponding to R through $R^5$.

14. The lubricating composition of claim 13 wherein $R^2$ and $R^3$ are each hydrogen and R, $R^1$, $R^4$ and $R^5$ are each independently hydrogen, chloro or lower alkyl.

15. The lubricating composition of claim 13 wherein the dienophile is further characterized that it contains at least one but not more than two $$-C(O)OR_0$$

wherein $R_0$ is the residue of unsaturated aliphatic alcohol of up to about 40 carbon atoms.

16. The lubricating composition of claim 14 wherein the diene is piperylene, isoprene, methylisoprene, chloroprene, 1,3-butadiene, or mixtures thereof.

17. The lubricating composition of claim 15 wherein the dienophile is an ester of acrylic acid or methacrylic acid.

18. The composition of claim 13 wherein the lubricating oil composition contains substantially no phosphorus.

* * * * *